US005447366A

United States Patent [19]

Cole

[11] Patent Number: 5,447,366

[45] Date of Patent: Sep. 5, 1995

[54] APPARATUS FOR DISPENSING DISCRETE ARTICLES

[76] Inventor: Lawrence N. Cole, 540 Kentucky St., Vallejo, Calif. 94590

[21] Appl. No.: 229,807

[22] Filed: Apr. 19, 1994

[51] Int. Cl.[6] ..... A47F 1/00

[52] U.S. Cl. ..... 312/50; 312/42; 312/202; 312/290; 312/212

[58] Field of Search ..... 312/50, 42, 216, 202, 312/290, 309, 322, 249.7, 199, 212, 283

[56] References Cited

U.S. PATENT DOCUMENTS

| | | | |
|---|---|---|---|
| 50,895 | 11/1865 | Boswell | 312/199 X |
| 1,723,417 | 8/1929 | Glass | 312/42 |
| 1,766,409 | 6/1930 | Stocks | 312/42 |
| 3,872,342 | 3/1975 | Dankert | 312/290 |
| 4,441,767 | 4/1984 | Stark | 312/216 |
| 4,561,705 | 12/1985 | Schäfer | 312/199 X |
| 4,597,614 | 7/1986 | Alexander | 312/42 |
| 4,850,511 | 7/1989 | Kral et al. | 312/42 X |
| 5,249,855 | 10/1993 | Franklin et al. | 312/138.1 |
| 5,269,597 | 12/1993 | Yenglin et al. | 312/42 |

FOREIGN PATENT DOCUMENTS

| | | | |
|---|---|---|---|
| 20804 | 1/1981 | European Pat. Off. | 312/42 |

*Primary Examiner*—Laurie K. Cranmer
*Assistant Examiner*—Janet M. Wilkens
*Attorney, Agent, or Firm*—Thomas R. Lampe

[57] ABSTRACT

Apparatus for dispensing discrete articles such as newspapers, magazines and other publications includes two housing members which are pivoted apart to obtain access to the interiors of the housing members. Covers on the housing members must be opened before the housing members can be swung apart. The housing members include a movable front panel having a plurality of front panel sections which abut against one another at shelf locations within the housing members.

10 Claims, 8 Drawing Sheets

APPARATUS FOR DISPENSING DISCRETE ARTICLES

TECHNICAL FIELD

This invention relates to apparatus for dispensing discrete articles. More particularly, the apparatus disclosed herein is a dispenser cabinet or rack utilized to display and allow manual retrieval of publications such as newspapers and magazines.

BACKGROUND ART

It is well known to display magazines, newspapers and other publications and provide for the dispensing thereof from the rack or cabinet. In some instances, access to the publication can only be had upon presentation of payment, e.g. insertion of coins into a coin box to release a latch or lock. It is also quite common to display and dispense publications at no cost.

Many existing prior art newspaper and magazine racks, whether free or coin operated, allow the consume access to the entire contents thereof. Pilferage of the entire contents or a significant portion thereof is a problem with such arrangements. Furthermore, many prior art dispensers do not readily lend themselves to dispensing a number of publications or publications of varying sizes.

DISCLOSURE OF INVENTION

The present invention relates to apparatus for dispensing discrete articles which is particularly adapted for use as a display cabinet and dispenser for newspapers, magazines or other publications. The apparatus can readily accommodate and provide for the dispensing of a number of publications and is adjustable to accommodate different publications. The apparatus is so constructed as to make it difficult for a consumer to withdraw the entire stack or stacks of publications contained in the interior thereof. However, the apparatus allows an attendant to service the dispenser rack by inserting or removing larger quantities of publications in a ready manner.

The apparatus of the present invention includes a first housing member and a second housing member.

Connector means connects the housing members together for relative movement whereby the housing members can assume either a first configuration or a second configuration.

Each of the housing members includes an inner side wall, an outer side wall, a back wall and a front wall. The walls define a housing member interior.

The front wall has at least one access opening formed therein communicating with the interior to allow manual access to discrete articles in the interior. The inner side wall defines at least one aperture communicating with the interior utilized to remove or replenish articles in the interior.

The housing members when assuming the first configuration have the inner walls thereof closely adjacent to one another to close off manual access to the apertures defined thereby. The housing members when assuming the second configuration have the inner walls thereof spaced apart and allowing ready manual access to the apertures defined thereby.

Securement means is provided for selectively securing the housing members in the first configuration.

The front wall of each of the housing members includes a movable front panel at least partially defining the at least one access opening.

Each of the housing members includes a cover movably connected to at least one of the walls thereof, the cover being selectively movable between a closed position wherein the interior is covered by the cover and an open position wherein the interior is uncovered by the cover. The cover, when in said closed position, is cooperable with the movable front panel to limit upward movement of the movable front panel and when in the open position permits unrestrained upward movement of the movable front panel.

Other features, advantages, and objects of the present invention will become apparent with reference to the following description and accompanying drawings.

BEST MODE FOR CARRYING OUT THE INVENTION

Figure 1:
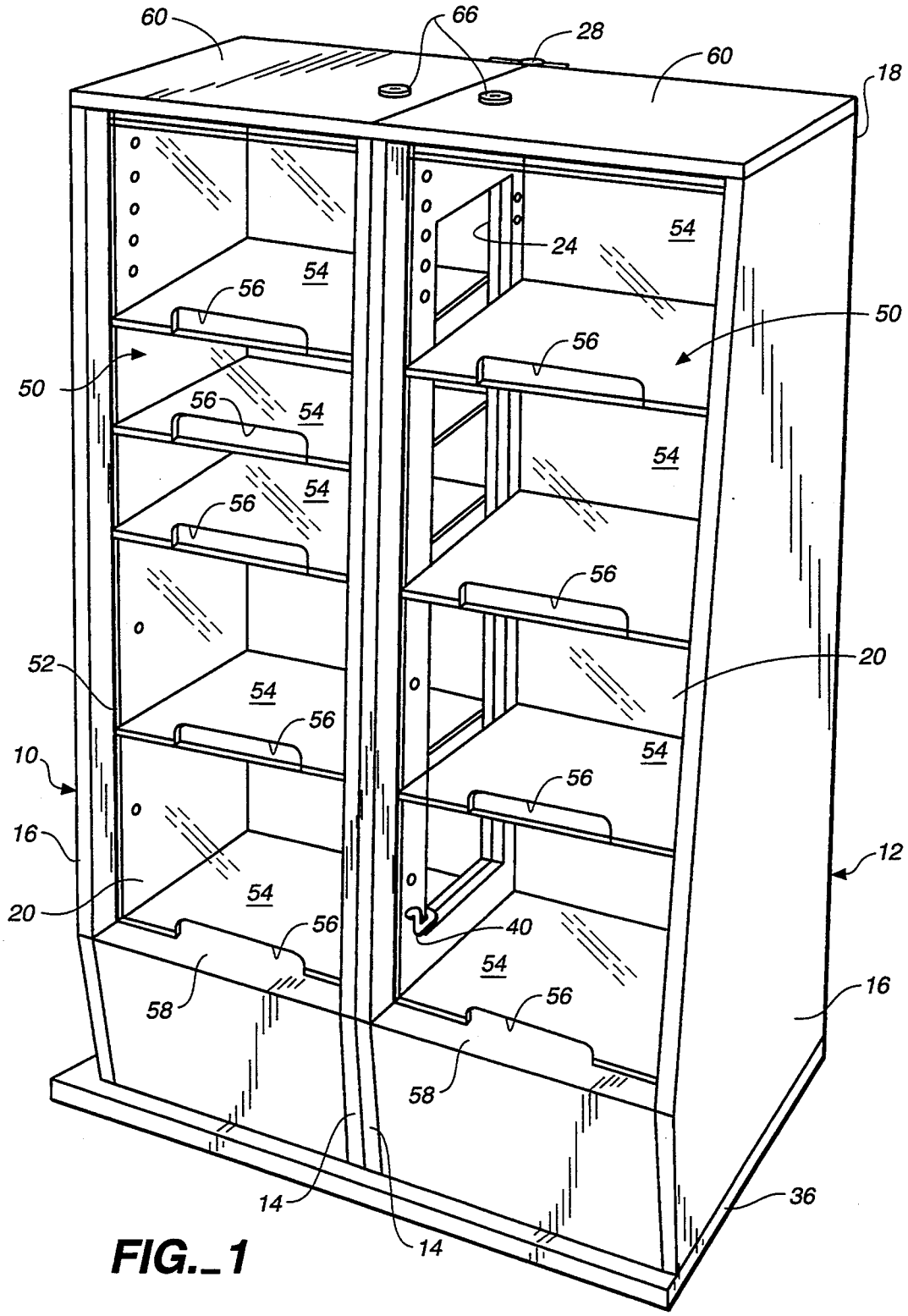
FIG. 1 is a perspective view of apparatus constructed in accordance with the teachings of the present invention.

Referring now to the drawings, the apparatus of the present invention includes a first housing member 10 and a second housing member 12. Each housing member includes an inner side wall 14, an outer side wall 16, a back wall 18 and a front wall 20, said walls defining a housing member interior. An elongated aperture 24 is defined by each inner side wall 14 and extends virtually along the full length thereof. Apertures 24 communicate with the interiors of their respective housing members. Apertures 24 are utilized to remove or replenish articles in the interiors. In the disclosed embodiment of the invention, the articles comprise publications 26.

Figure 5:
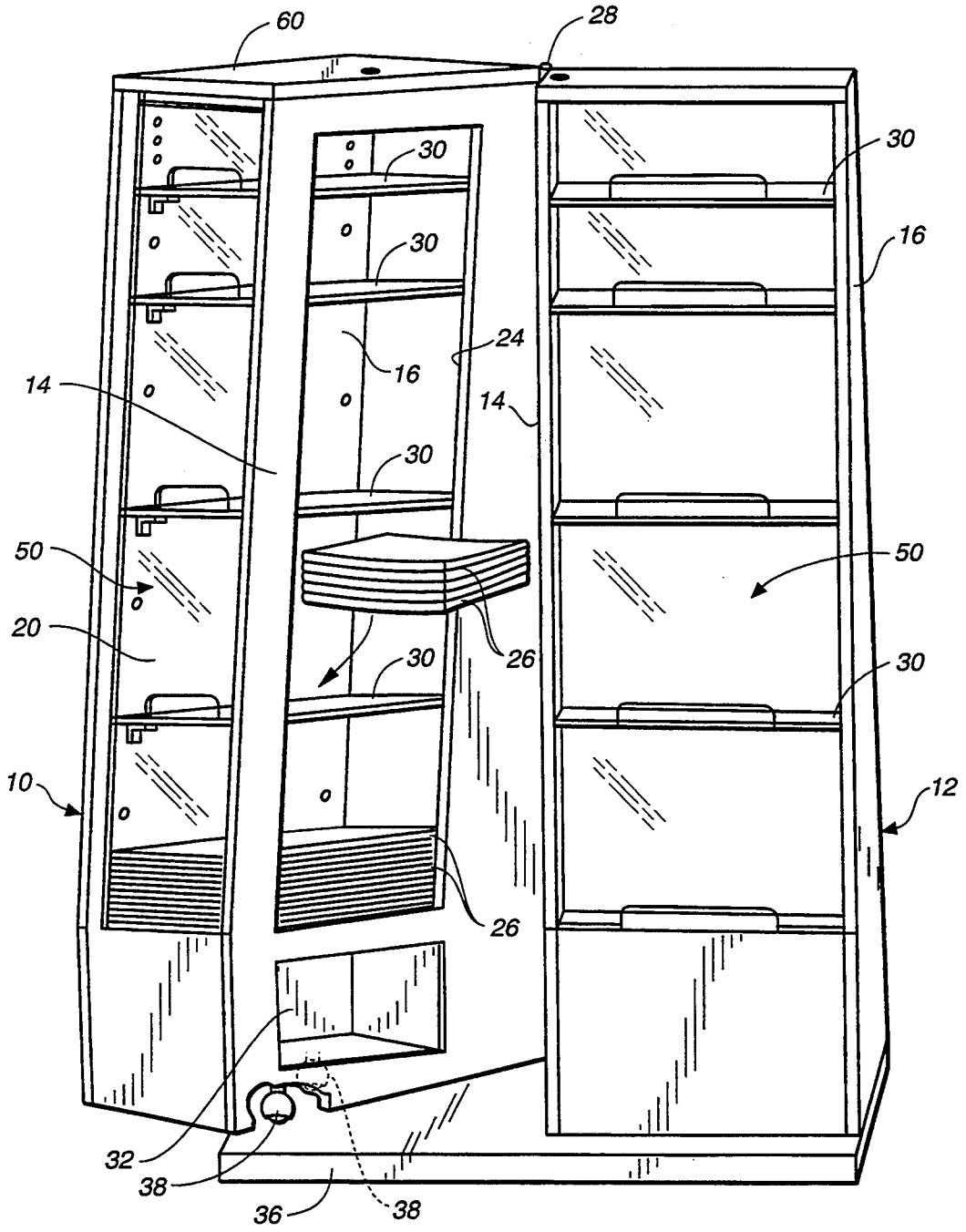
FIG. 5 is a frontal, perspective view of the apparatus showing the housing members thereof swung apart for access to the interiors thereof.
Figure 5A:
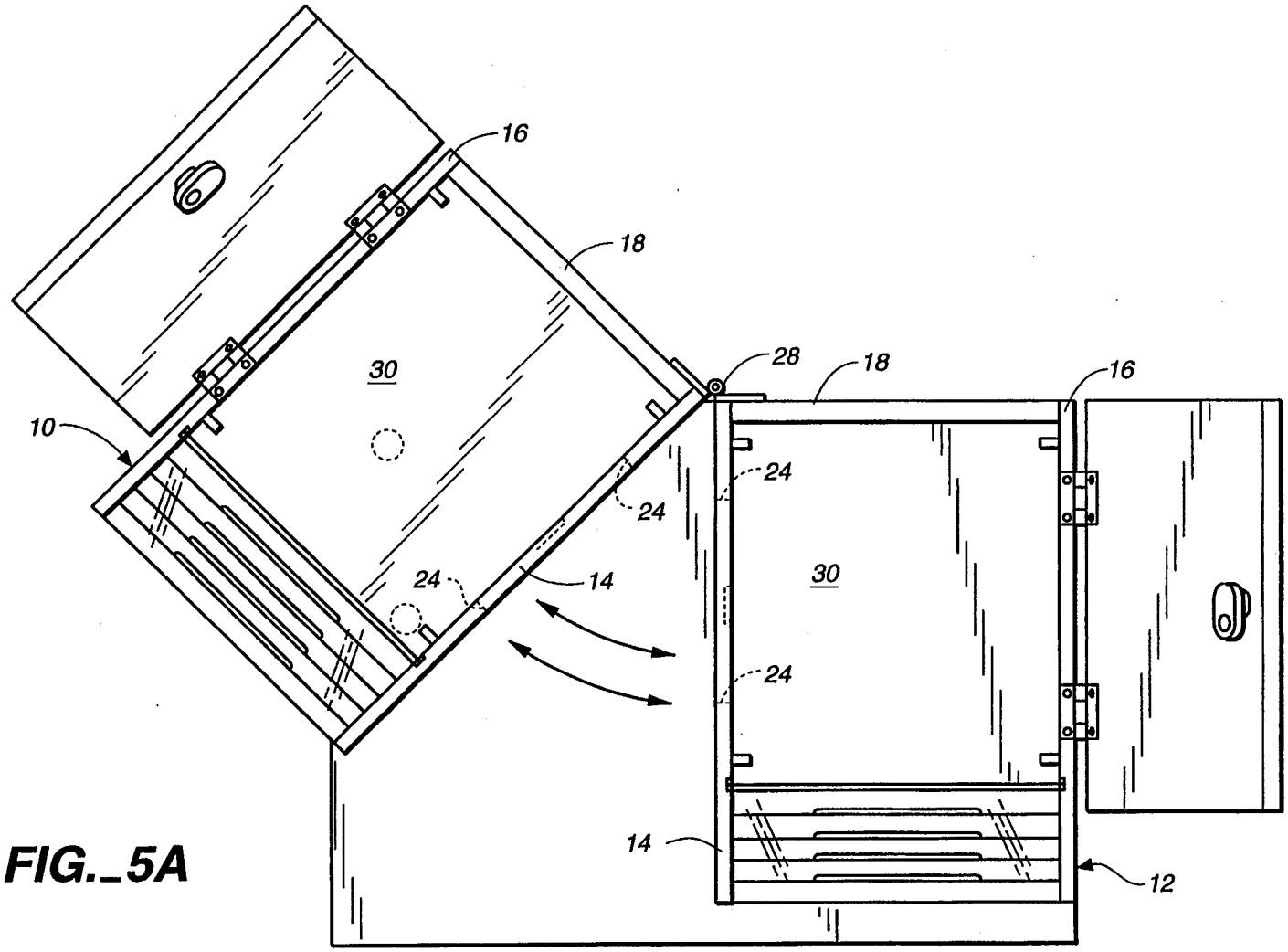
FIG. 5A is a top, plan view showing the apparatus with the housing members swung apart as in FIG. 5 but illustrating apparatus covers open, rather than closed as shown in FIG. 5.

One or more hinges 28 are connected to the back walls 18 of the housing members and allow the housing members to pivot relative to each other from a first configuration assumed thereby and shown in FIG. 1 and a second configuration illustrated in FIG. 5. In the first configuration, the inner walls of the housing members are closely adjacent to one another to close off manual access to the apertures 24 defined thereby. The housing members, when assuming the second configuration, have the inner side walls thereof spaced apart, thus allowing ready manual access to the apertures.

FIG. 5 shows one illustrated stack of publications 26 being placed on a shelf 30 within the interior of the first housing member 10. It is to be noted that a plurality of shelves 30 are disposed in each of the housing members. Also with reference to FIG. 5, it should be noted that the inner side wall of first housing member 10 also opens to a recess 32 defined by the first housing member which can be used for storage.

In the illustrated embodiment of the invention, housing members 10 and 12 are positioned on a base member 36. A plurality of rollers 38 of any suitable construction project downwardly from first housing member 10 and into engagement with the base member 36. Such an arrangement facilitates movement of first housing member 10 relative to second housing member 12 and also relative to the base member. In the illustrated embodiment, second housing member 12 is shown as being fixed relative to the base member; however, if desired, both housing members can be mounted for movement relative to each other and relative to the base member.

Figure 8:
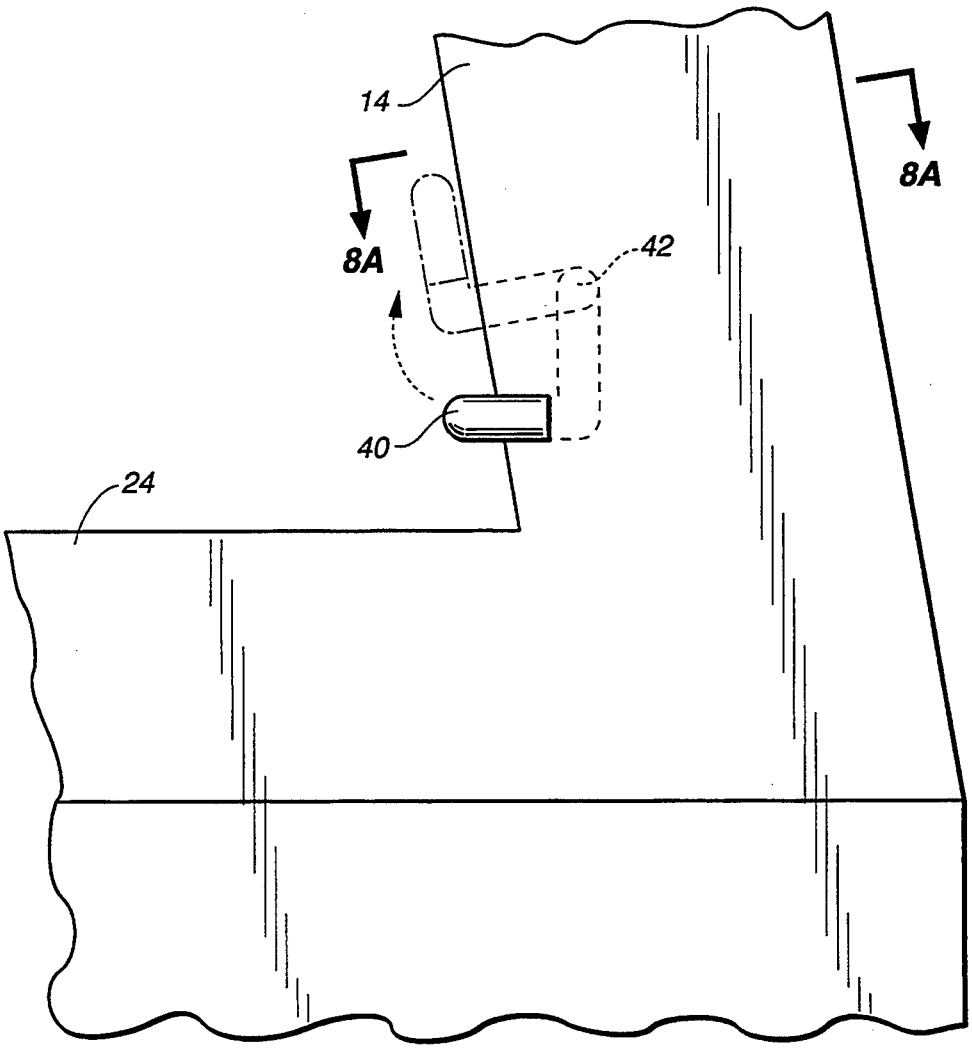
FIG. 8 is a greatly enlarged view taken along the line 8—8 in FIG. 2.
Figure 8A:
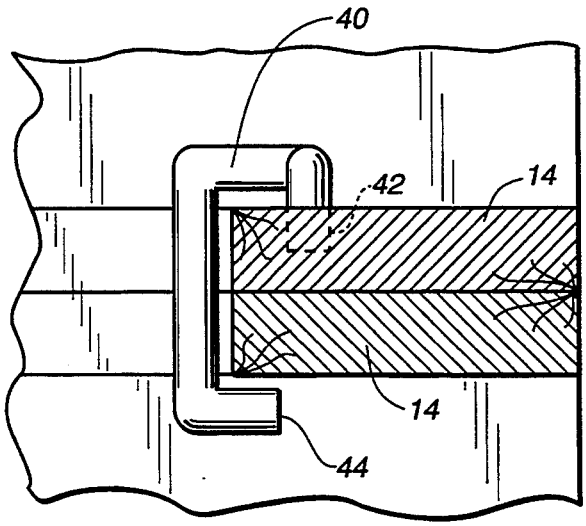
FIG. 8A is a view taken along the line 8A—8A in FIG. 8.

A securement member 40 is utilized to secure the housing members 10, 12 in the configuration shown in FIG. 1. As can be seen with reference to FIGS. 8 and 8A, the securement member comprises an irregularly shaped securement bar having one end 42 thereof pivotally mounted in a recess formed in one of the inner side walls 14 and a distal end 44. The securement member 40 can be manually moved between the solid line position illustrated in FIGS. 8 and 8A to the position illustrated in phantom in FIG. 8. When a securement member is in the solid line position, distal end 44 thereof will be positioned to prevent the inner side walls 14 from moving away from each other. When, however, the securement member is swung to the position shown in phantom in FIG. 8, the distal end will be located fully in aperture 24 and the housing members are free to be moved manually from the first configuration to the second configuration.

The front wall of each of the housing members includes a movable front panel 50 which is slidably disposed within grooves 52 formed in the inner and outer side walls of the housing members. Each front panel 50 is comprised of a plurality of discrete, aligned front panel sections 54 in abutting relationship with one another. The front panel sections are preferably formed of transparent material such as plastic sheet material.

The front panel sections 54 abut at the locations of the shelves 30 within the housing member interiors. Each of the front panel sections has a cutout 56 formed at the bottom thereof which is for the purpose of providing manual access to the interior of the housing members. The lowermost front panel section rests upon a fixed shelf 58 which projects forwardly a distance greater than the shelves 30.

A person wishing to retrieve a publication from the interior of one of the housing members places his or her hand within the cutout 56 located at the particular shelf supporting the publication. Upward pressure on that particular front panel section will cause it to move up along with the front panel sections resting thereon. Upward movement thereof will be terminated by engagement of the uppermost front panel section 54 with a cover 60. This action is shown in FIGS. 6 and 7, FIG. 6 showing an uppermost front panel section 54 just prior to engagement with a cover 60 and FIG. 7 showing the front panel 54 engaging the cover.

Figure 7:
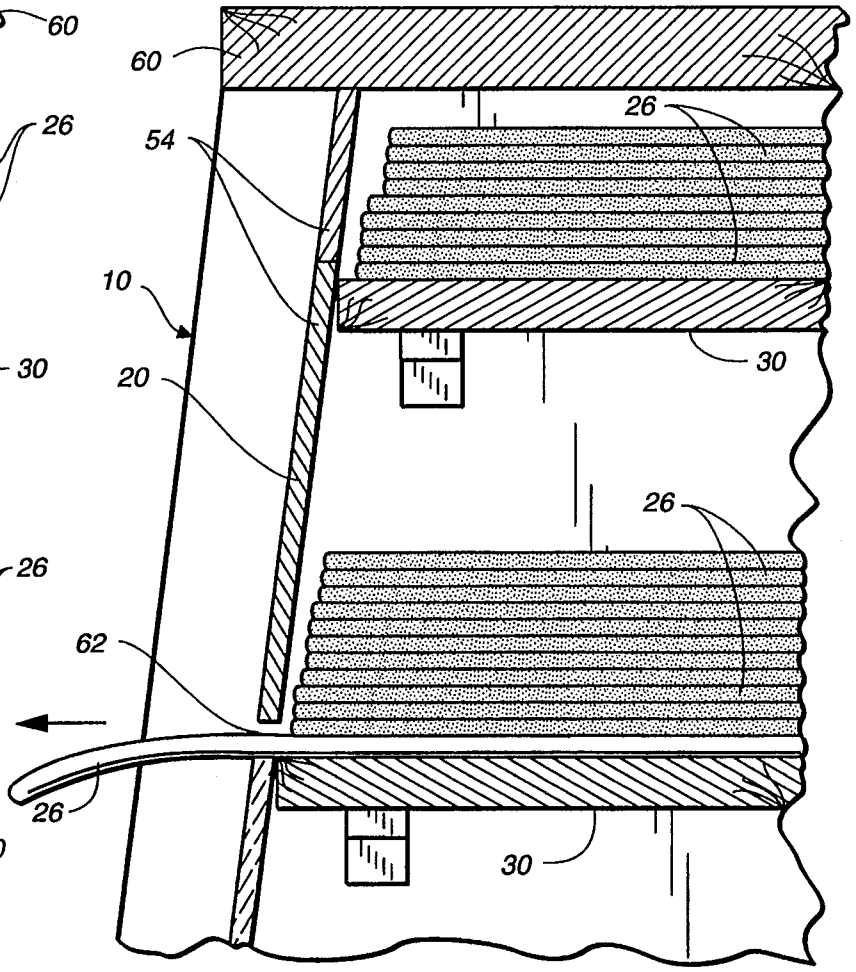
FIG. 7 is a view similar to FIG. 6, but illustrating a raised front panel section allowing dispensing of a publication through an access opening.

In FIG. 7, a publication 26 is shown being removed from the enlarged access opening 62 created when its respective front panel section 54 has been lifted. It should be noted, however, that the access opening 62 is still quite small and that it is difficult for an individual to retrieve a significant number of the publications at one time.

Figure 6:
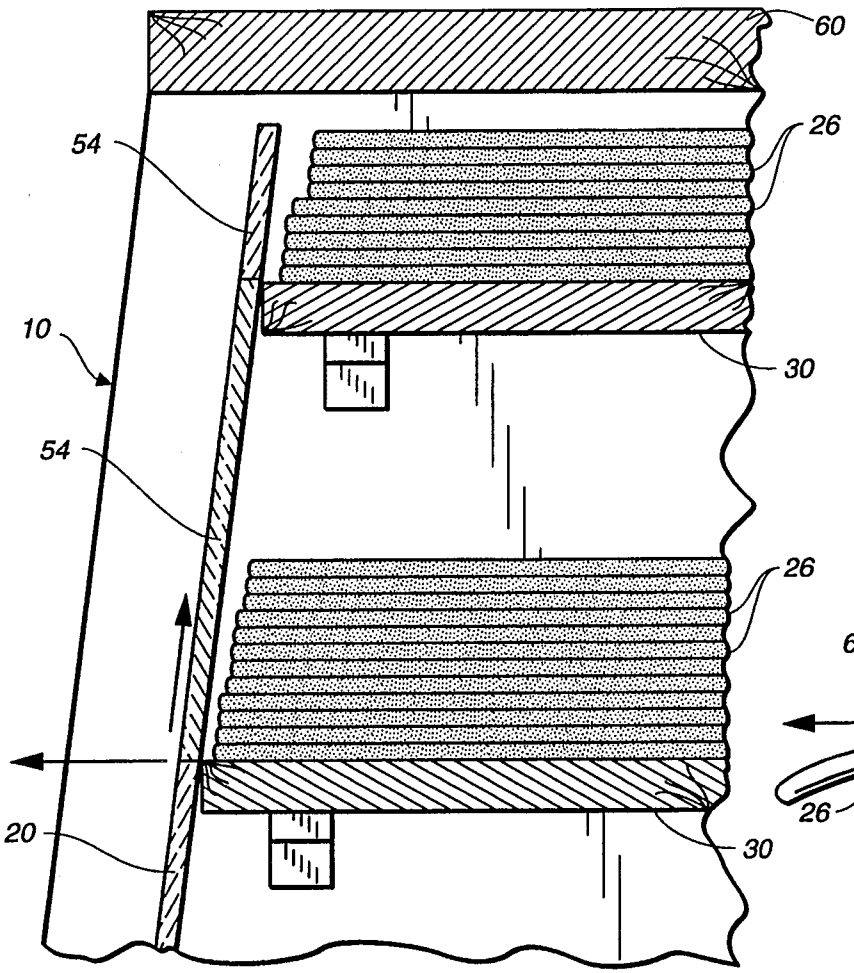
FIG. 6 is an enlarged, cross-sectional view taken along the line 6—6 in FIG. 2.

As long as the covers 60 are closed as shown in FIGS. 1, 6 and 7, for example, the securement member 40 cannot be manually accessed and manipulated since it is behind the front panel 50. Thus, the housing members are locked against relative movement.

Figure 2:
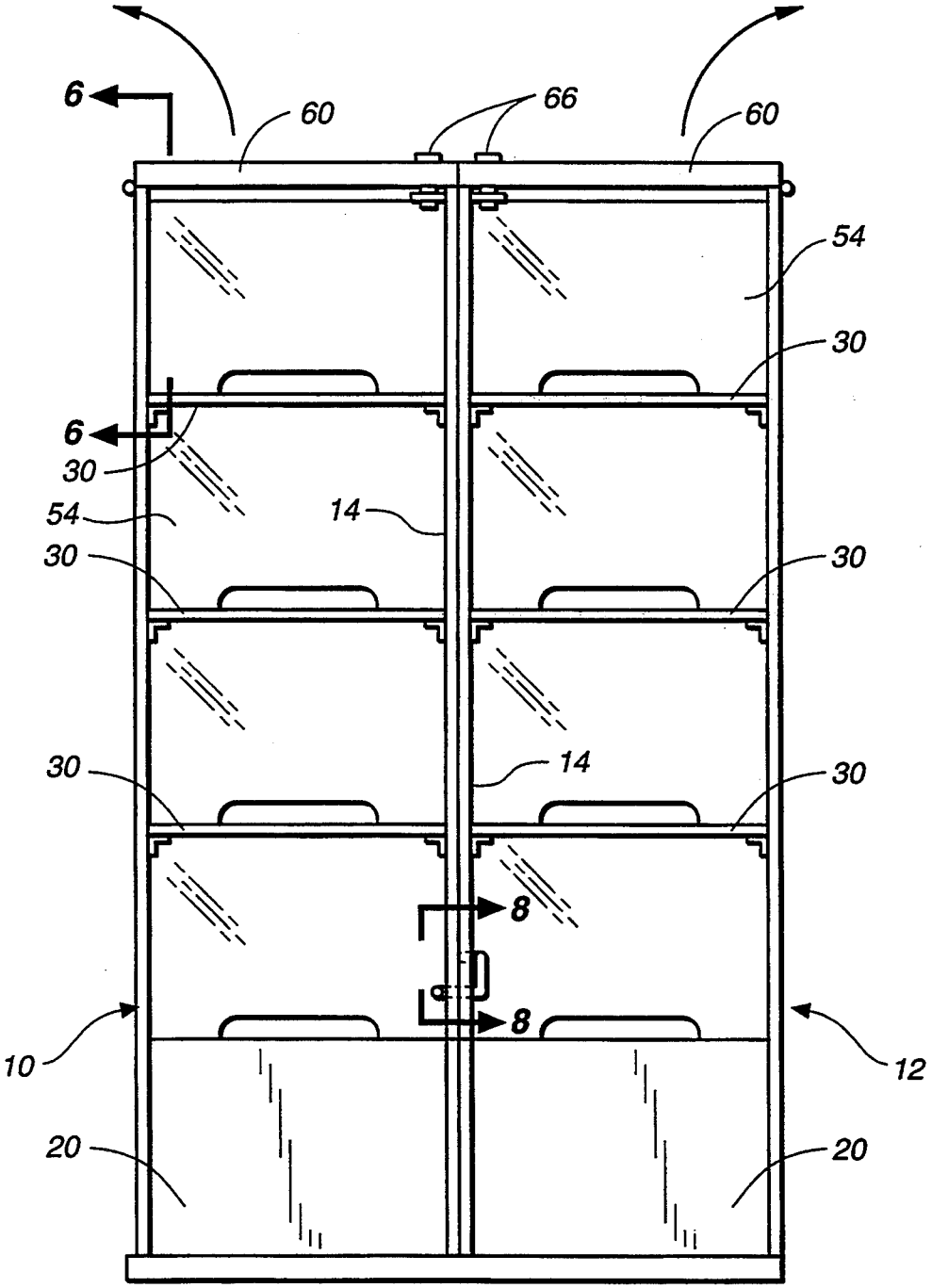
FIG. 2 is a front, elevational view of the apparatus.

The covers 60 are pivotally mounted on outer side walls 16 of their respective housing members by hinges 64. The covers 60 may be moved from the closed position shown in FIGS. 1 and 2, for example, to the open positions shown in FIGS. 3, 3A and 4, for example. Locks 66 of any suitable type are utilized to lock the covers closed.

One wishing to have access to the housing member interiors through apertures 24 in the inner side walls unlocks locks 66 and moves the covers to open position. When this occurs, the entire front panels 50 can be lifted in unrestrained fashion so that the operator can unsecure securement member 40. This will enable the first housing member 10 to be swung away and the housing members to be disposed in their second configuration.

Figure 3:
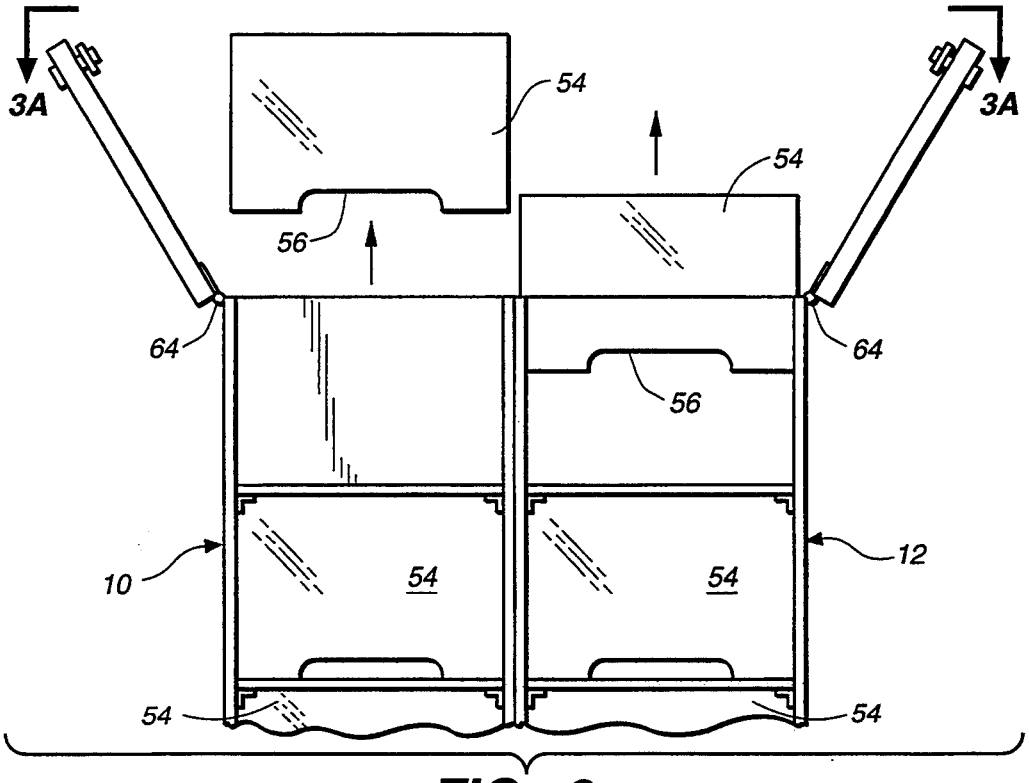
FIG. 3 is a front, elevational view of a segment of the apparatus illustrating front panel sections being removed therefrom.
Figure 4:
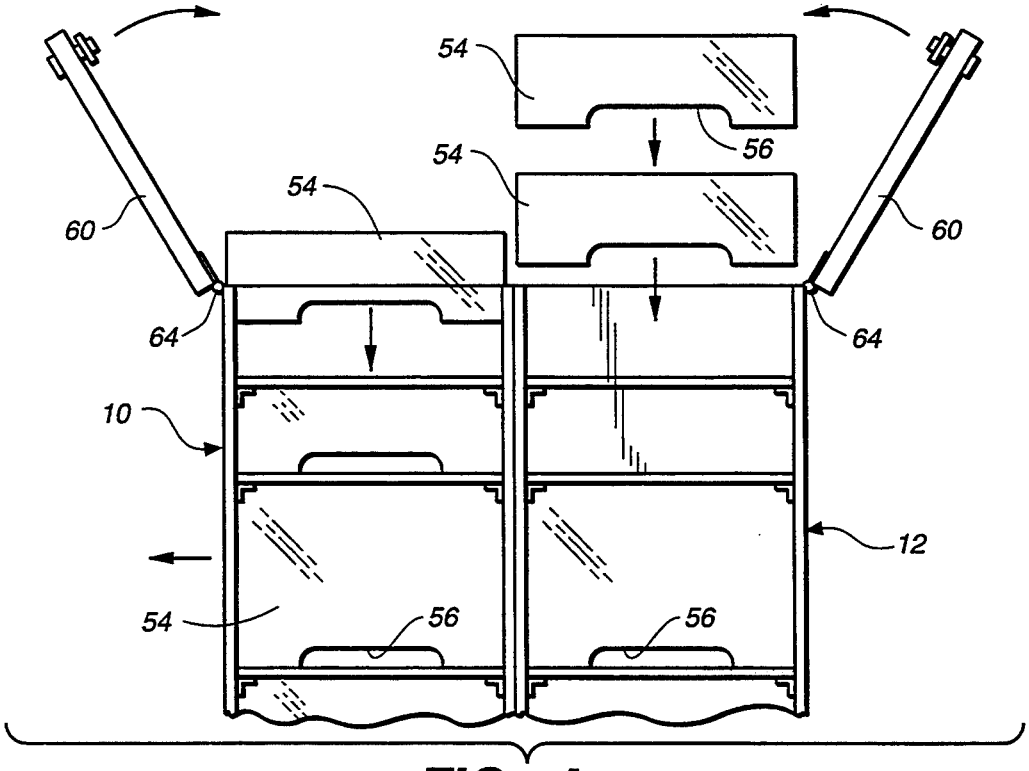
FIG. 4 is a view similar to that of FIG. 3 but illustrating front panel sections being installed.
Figure 3A:
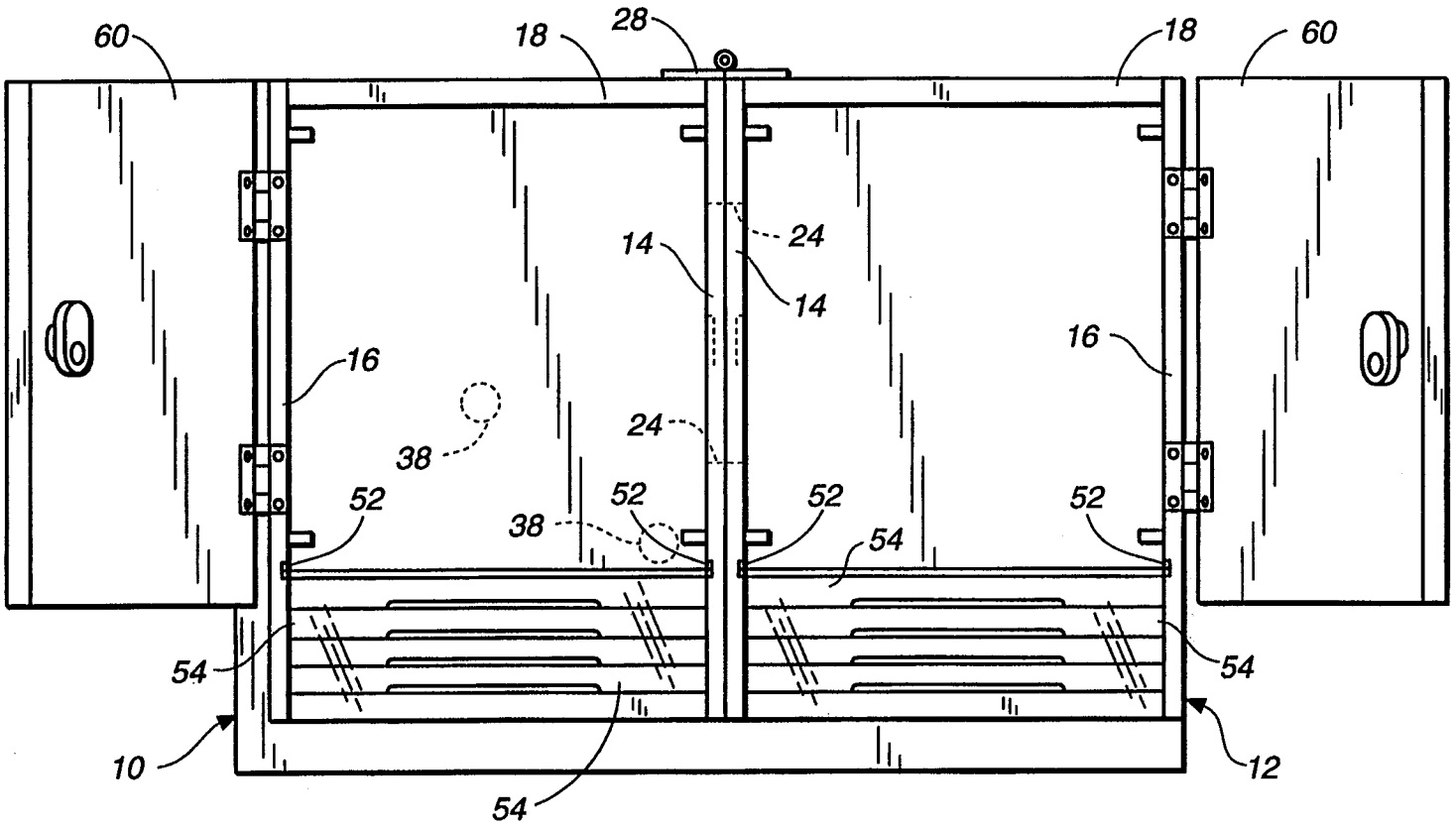
FIG. 3A is a top, plan view taken in the direction of line 3A—3A in FIG. 3.

FIGS. 3 and 4 illustrate another advantage residing in the structural arrangement just described. When the covers 60 are open, the front panel sections 54 can be removed and, if desired, replaced by different sized front panel sections. Shelves 30 can also be moved so that the relative positions therebetween can be changed. It is normally desirable for the abutting edges of the front panel sections 54 to be located at the shelves as previously described.

I claim:

1. Apparatus for dispensing discrete articles, said apparatus comprising, in combination:

a first housing member;

a second housing member;

connector means connecting said housing members together for relative movement whereby said housing members can assume either a first configuration or a second configuration, each said housing member including an inner side wall, an outer side wall, a back wall and a front wall, said walls defining a housing member interior, said front wall having at least one access opening formed therein communicating with said interior to allow manual access to discrete articles in said interior, and said inner side wall defining at least one aperture communicating with said interior utilized to remove or replenish articles in said interior, said housing members when assuming said first configuration having the inner side walls thereof closely adjacent to one another to close off manual access to the apertures defined thereby, and said housing members when assuming said second configuration having the inner side walls thereof spaced apart and allowing ready manual access to the apertures defined thereby; and securement means for selectively securing said housing members in said first configuration, said front wall of each of said housing members including a movable front panel at least partially defining said at least one access opening, and each of said housing members including a cover movably connected to at least one of said walls thereof, said cover being selectively movable between a closed position wherein the interior is covered by said cover and an open position wherein the interior is uncovered by said cover, said cover when in said closed position being cooperable with said movable front panel to limit upward movement of said movable front panel and when in said open position permitting unrestrained upward movement of said movable front panel.

2. The apparatus according to claim 1 additionally comprising a lock for locking said cover in closed position.

3. The apparatus according to claim 2 wherein said securement means is manually actuatable and located within said interior and behind said movable front panel, said securement means being unaccessible to manual access when said cover is in said closed position and upward movement of said movable front panel limited by said cover.

4. The apparatus according to claim 3 wherein said securement means comprises a securement member attached to the inner side wall of one of said housing members and selectively engageable with the inner side wall of the other of said housing members to prevent relative movement between said inner side walls when said housing members assume said first configuration.

5. The apparatus according to claim 1 wherein said connector means comprises hinge means connecting said housing members at the back walls thereof.

6. The apparatus according to claim 1 wherein said apparatus additionally comprises a base member for supporting said housing members, and at least one roller element disposed between the base member and at least one of said housing members to facilitate relative movement between said housing members.

7. The apparatus according to claim 1 wherein said apparatus comprises a dispensing rack for publications.

8. Apparatus for dispensing discrete articles, said apparatus comprising, in combination:

a first housing member;

a second housing member;

connector means connecting said housing members together for relative movement whereby said housing members can assume either a first configuration or a second configuration, each said housing member including an inner side wall, an outer side wall, a back wall and a front wall, said walls defining a housing member interior, said front wall having at least one access opening formed therein communicating with said interior to allow manual access to discrete articles in said interior, and said inner side wall defining at least one aperture communicating with said interior utilized to remove or replenish articles in said interior, said housing members when assuming said first configuration having the inner side walls thereof closely adjacent to one another to close off manual access to the apertures defined thereby, and said housing members when assuming said second configuration having the inner side walls thereof spaced apart and allowing ready manual access to the apertures defined thereby; and securement means for selectively securing said housing members in said first configuration, said front wall of each of said housing members including a movable front panel at least partially defining said at least one access opening, and said movable front panel being slidably disposed in grooves defined by said side walls and comprising a plurality of discrete, aligned front panel sections in abutting relationship with one another and each defining an access opening.

9. The apparatus according to claim 8 wherein said apparatus additionally comprises a plurality of shelves located in each of said housing members, said shelves for supporting a plurality of discrete articles thereon and said front panel sections abutting at the locations of said shelves.

10. The apparatus according to claim 8 wherein said front panel sections are transparent.

* * * * *